US006932392B1

(12) United States Patent
Geislhardt

(10) Patent No.: US 6,932,392 B1
(45) Date of Patent: Aug. 23, 2005

(54) DOOR LATCH

(75) Inventor: Alan C. Geislhardt, Fon du Lac, WI (US)

(73) Assignee: Plyco Corporation, Elkhart Lake, WI (US)

( * ) Notice: Subject to any disclaimer, the term of this patent is extended or adjusted under 35 U.S.C. 154(b) by 25 days.

(21) Appl. No.: 10/774,988

(22) Filed: Feb. 7, 2004

(51) Int. Cl.[7] ..... E05C 5/02
(52) U.S. Cl. ..... 292/61; 292/336.3; 292/DIG. 13
(58) Field of Search ..... 292/336.3, 63–64, 292/66–67, 69, 109, 113–114, 100, 58–62; 403/348–350, 403/353

(56) References Cited

U.S. PATENT DOCUMENTS 1,928,734 A * 10/1933 Nelson ..... 292/67
2,020,188 A * 11/1935 Johnson ..... 292/114
2,529,009 A * 11/1950 Foss ..... 292/67
2,603,512 A * 7/1952 Schatzman ..... 292/114
3,583,738 A * 6/1971 Uphoff et al. ..... 292/67
3,891,253 A * 6/1975 Revell ..... 292/336.3
3,929,360 A * 12/1975 Gulistan ..... 292/67
4,494,781 A * 1/1985 Lafosse ..... 292/60
4,591,176 A * 5/1986 Kassai ..... 292/336.3
4,674,777 A * 6/1987 Guelck ..... 292/336.3
5,275,029 A * 1/1994 Myers ..... 292/60
5,568,953 A * 10/1996 Showalter ..... 292/101
6,003,908 A * 12/1999 King ..... 292/61

* cited by examiner

*Primary Examiner*—Daniel P. Stodola
*Assistant Examiner*—Christopher Boswell
(74) *Attorney, Agent, or Firm*—Donald J. Ersler

(57) ABSTRACT

A door latch includes an S-handle, a mounting plate, a locking mounting plate, a handle latch and a locking spring. One end of the S-handle is terminated with a latch extension. A locking key extends from the S-handle. Each mounting plate includes a handle hole. A lock slot is formed adjacent the handle hole in the locking mounting plate. The lock slot receives the locking key. The handle latch includes a hook member and at least one mounting flange extending from a rear of the hook member. The hook member is sized to receive the latch extension. The S-handle is secured to a door with the mounting plates and the handle latch is secured to a surface, adjacent the door. A second embodiment of a door latch includes a torsion spring. The second embodiment of the door latch is used to lock a sliding door.

16 Claims, 6 Drawing Sheets

DOOR LATCH

BACKGROUND OF THE INVENTION

1. Field of the Invention

The present invention relates generally to latches and more specifically to a door latch, which may be used to prevent an animal from opening a door.

2. Discussion of the Prior Art

It appears that the prior art does not disclose a door latch that may be used to prevent an animal from opening a swinging or sliding door.

Accordingly, there is a clearly felt need in the art for a door latch that prevents an animal from opening a swinging or sliding door, but allows a child to open the swinging or sliding door.

SUMMARY OF THE INVENTION

The present invention provides a door latch, which may be used to prevent an animal from opening a door. The door latch includes an S-handle, a mounting plate, a locking mounting plate, a handle latch and a locking spring. One end of the S-handle is terminated with a latch extension. A locking key is preferably secured to a straight portion of the S-handle. The mounting plate includes a handle hole and at least two fastener openings. The locking mounting plate includes a locking handle hole and at least two fastener openings. A lock slot is formed adjacent the locking handle hole. The lock slot is sized to receive the locking key. The handle latch includes a hook member and at least one mounting flange extending from a rear of the hook member. At least two fastener openings are formed through the at least one mounting flange. The hook member is sized to receive the latch extension. A second mounting plate includes an offset bearing portion. At least two fastener openings are formed through the second mounting plate and a second handle hole is formed through the offset bearing portion.

The door latch is preferably installed in the following manner. A handle opening and at least two fastener openings are formed through a door. The at least two fastener openings provide clearance for the at least two fasteners. The locking mounting plate is first pushed over the one end of the S-handle on to the straight portion of the S-handle. The second mounting plate is finally pushed over the one end of the S-handle until thereof is adjacent to the second locking mounting plate. The locking spring is pushed over the other end of the S-handle until thereof is near the locking key. The other end of the S-handle is inserted through the handle opening. The mounting plate is finally pushed over the other end of the S-handle. The mounting plate, the locking mounting plate and the second mounting plate are retained against the door with the at least two fasteners. The handle latch is attached to a mounting surface adjacent the door, such that the latch extension is received by the hook member.

A second embodiment of a door latch includes a torsion S-handle, a first mounting plate, a second mounting plate, the handle latch and a torsion spring. The torsion S-handle is identical to the S-handle with the exception of the locking key. The torsion spring is secured to a straight portion of the torsion S-handle with any suitable method. The first mounting plate includes a handle hole, a first spring retention opening and at least two fastener openings. The second mounting plate includes a handle hole, a second spring retention opening and at least two fastener openings.

Accordingly, it is an object of the present invention to provide a door latch that prevents an animal from opening a swinging or sliding door, but allows a child to open the swinging or sliding door.

These and additional objects, advantages, features and benefits of the present invention will become apparent from the following specification.

DETAILED DESCRIPTION OF THE PREFERRED EMBODIMENTS

Figure 1:
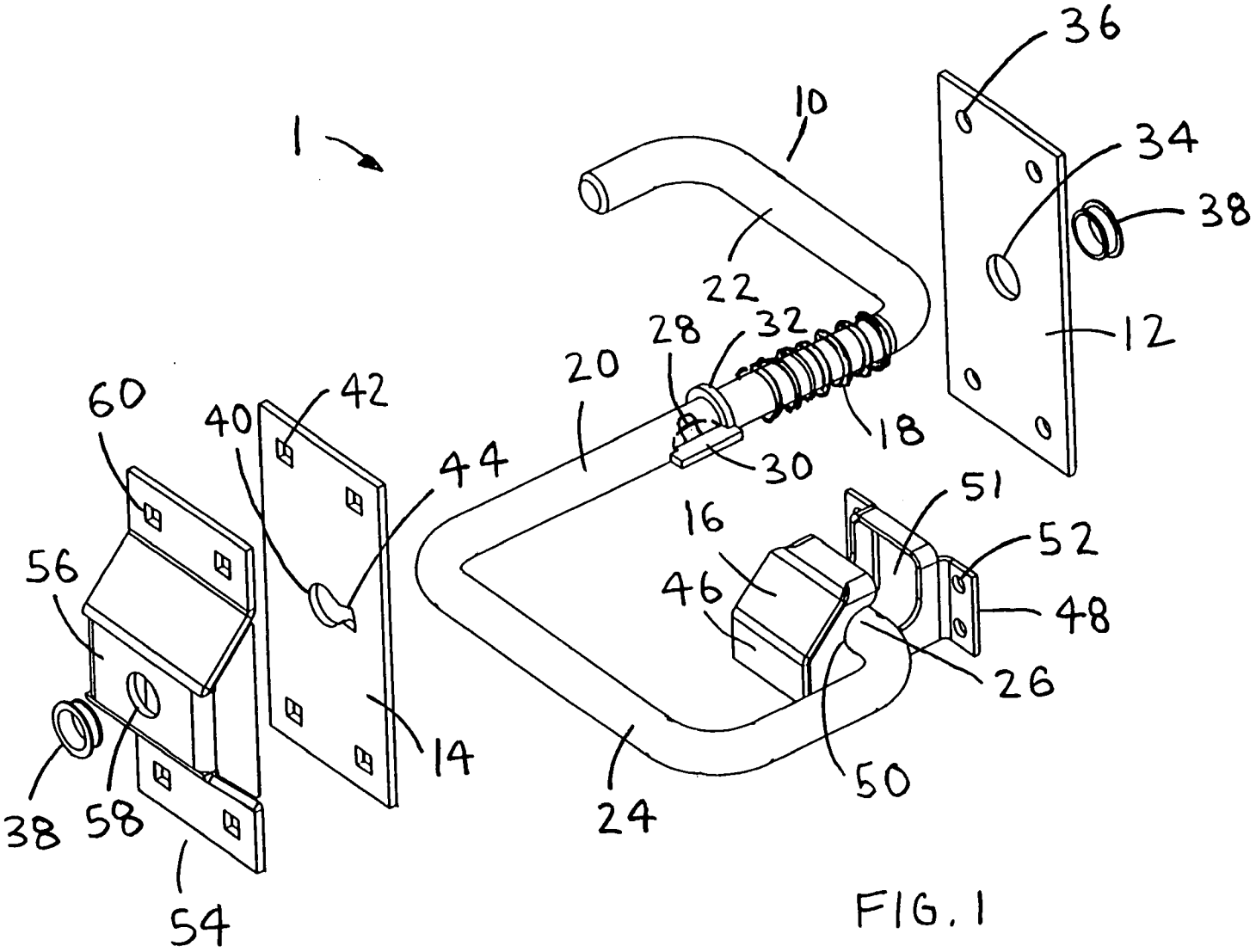
FIG. 1 is a partially exploded perspective view of a door latch in accordance with the present invention.
Figure 2:
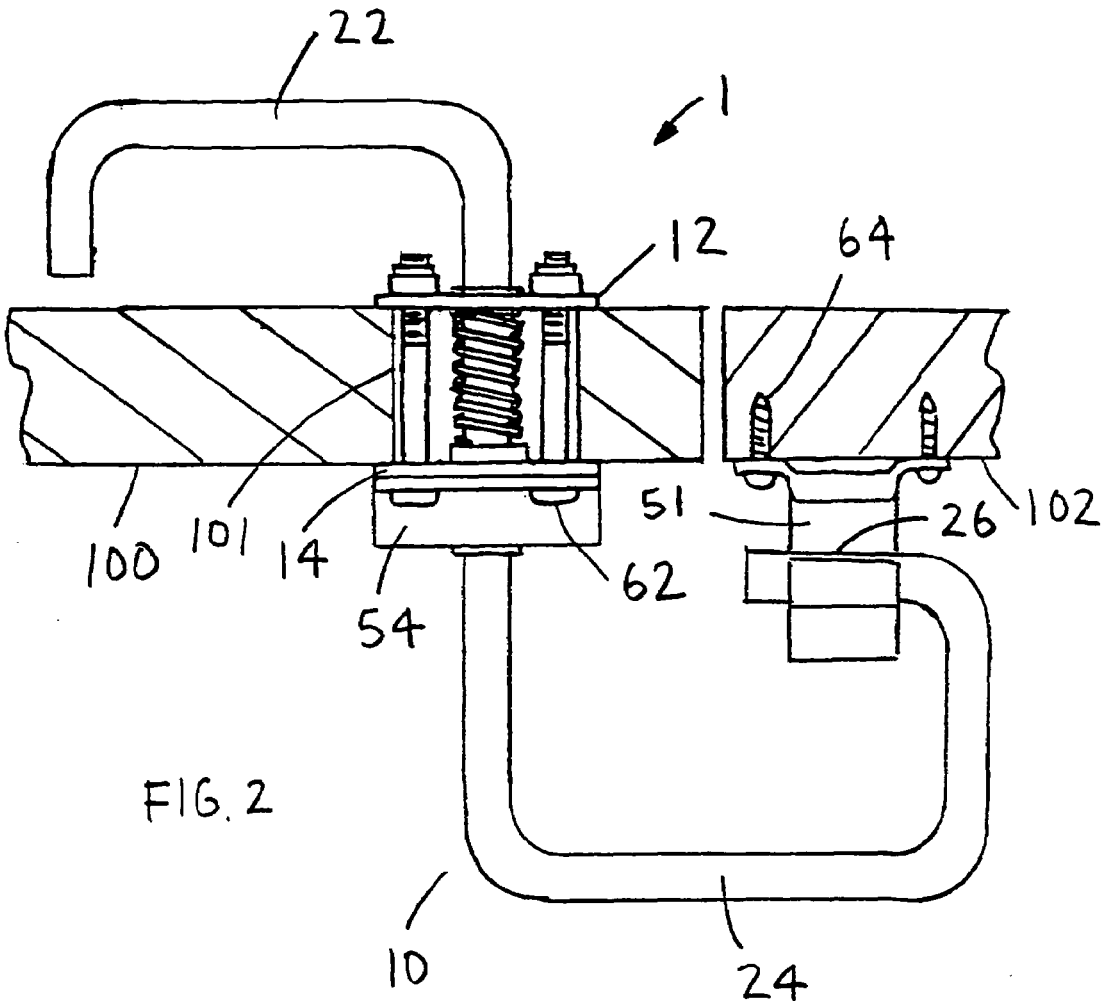
FIG. 2 is a top cross sectional view of a door latch installed in a swinging door in accordance with the present invention.
Figure 3A:
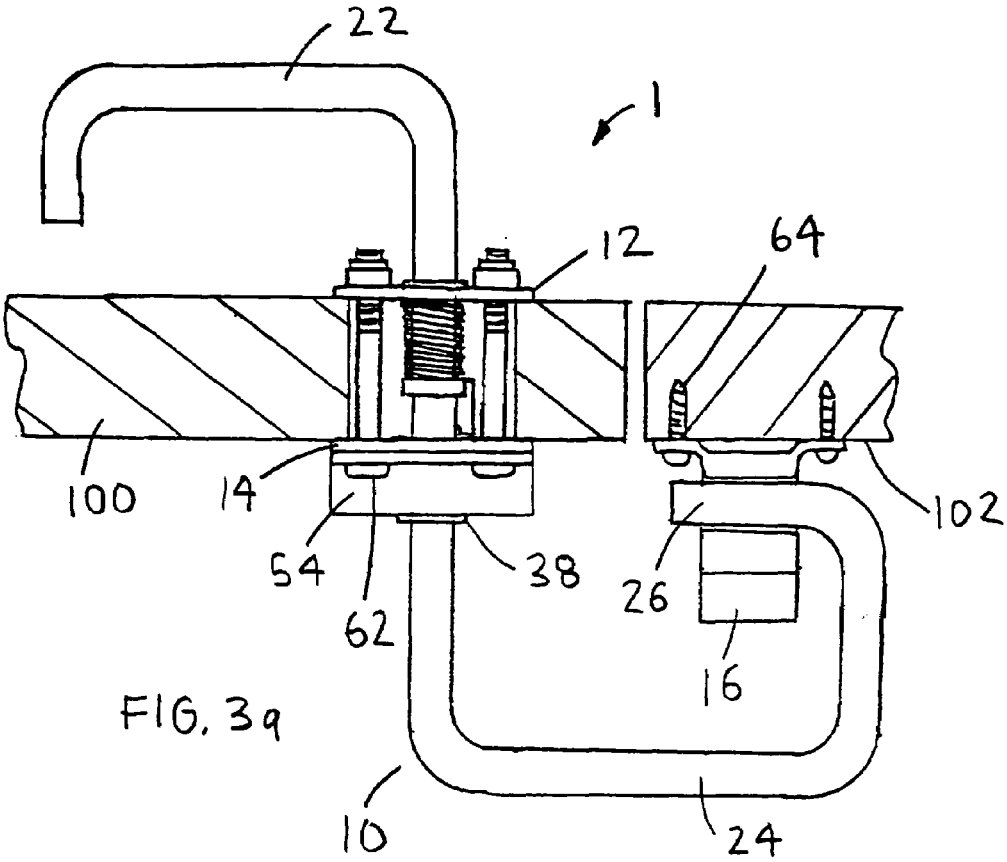
FIG. 3*a* is a top cross sectional view of a door latch installed in a swinging door with an S-handle positioned in an open position in accordance with the present invention.
Figure 3B:
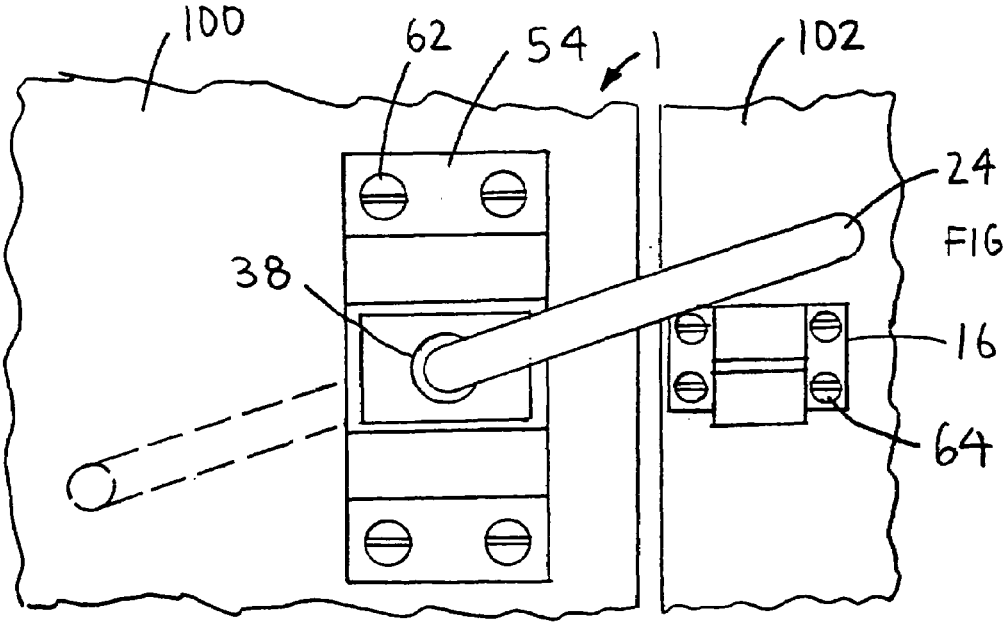
FIG. 3*b* is a front view of a door latch installed in a swinging door with an S-handle positioned in an open position in accordance with the present invention.

With reference now to the drawings, and particularly to FIG. 1, there is shown a partial exploded perspective view of a door latch 1. With reference to FIGS. 2–3*b*, the door latch 1 includes an S-handle 10, a mounting plate 12, a locking mounting plate 14, a handle latch 16 and a locking spring 18. The S-handle includes a straight portion 20, a handle portion 22, and a locking portion 24. The locking portion 24 extends from one end of the straight portion 20 and the handle portion 22 extends from the other end of the straight portion 20. A latch extension 26 extends from an end of the locking portion 24. A specific S-handle 10 has been shown and described, however other designs of handles may also be used. Preferably, a key slot 28 is formed in substantially a middle of the straight portion 20 to receive a locking key 30. However, other methods of securing the locking key 30 to the straight portion 20 may also be used. A spring collar 32 is preferably retained on the straight portion 20, adjacent the locking key 30.

The mounting plate 12 includes a handle hole 34 and at least two fastener openings 36. The handle hole 34 is sized to receive a handle bearing 38. The handle bearing 38 is preferably a snap-in bearing, fabricated from nylon. However, other types of bearings may also be used. The locking mounting plate 14 includes a locking handle hole 40 and at least two fastener openings 42. A lock slot 44 is formed adjacent the locking handle hole 40. The lock slot 44 is sized to receive the locking key 30. The mounting plate 12 and the locking mounting plate 14 pivotally retain the S-handle 10. The handle latch 16 includes a hook member 46 and at least one mounting flange 48 extending from a rear of the hook member 46. An extension slot 50 is formed in the hook member 46 to receive the latch extension 26. An extension passage 51 is also formed in the hook member 46 to allow passage of latch extension 26 to the extension slot 50. At least two fastener openings 52 are formed through the at least one mounting flange 48. A second mounting plate 54 includes an offset bearing portion 56. A second handle hole 58 is formed through the offset portion 56 to receive a single handle bearing 38. At least two fastener openings 60 are formed through the second mounting plate 54 at the top and bottom thereof.

The door latch 1 is preferably installed in the following manner. A handle opening 101 is formed through a door 100. The handle opening 101 is large enough to provide clearance for the locking key 30 and the spring collar 32. The handle opening 101 may also provide clearance for the at least two fasteners 62 or separate openings may be created for the at least two fasteners 62. The locking mounting plate 14 is first pushed over the locking portion 24 on to the straight portion 20. The second mounting plate 54 is pushed over the locking portion 24, adjacent to the locking mounting plate 14. The locking spring 18 is pushed over the S-handle 10 until thereof is adjacent the spring collar 32. The other end of the S-handle 10 is inserted through the handle opening. The mounting plate 12 is finally pushed over the handle portion 22 on to the straight portion 20. The mounting plate 12, the locking mounting plate 14 and the second mounting plate 54 are retained against the door with the at least two fasteners 62.

The handle latch 16 is attached to a mounting surface 102 adjacent the door 100 with at least two fasteners 64, such that the latch extension 26 is received by the extension slot 50. The door latch 1 is opened pushing the locking portion 24 toward the mounting surface 102 and pivoting the locking portion 24 upward, or by pulling the handle portion 22 away from the door 100 and pivoting the handle portion 22 downward. The straight portion 20 of the S-handle 10 is moved axially to remove the latch extension 26 from the extension slot 50.

Figures 4, 4A:
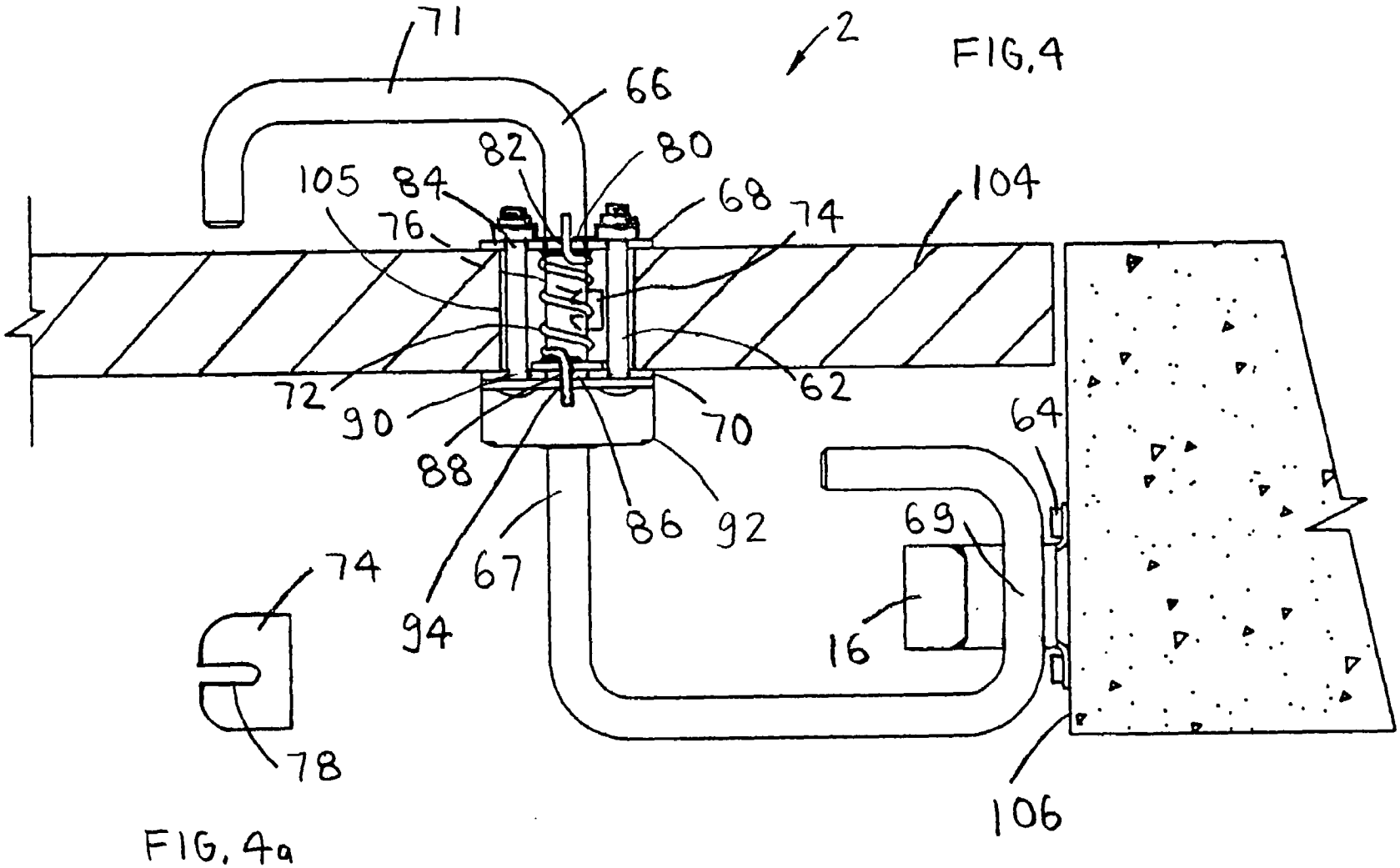
FIG. 4 is a top cross sectional view of a second embodiment of a door latch installed in a sliding door in accordance with the present invention.
FIG. 4*a* is an enlarged top view of a torsion spring retention key of a second embodiment of a door latch installed in a sliding door in accordance with the present invention.
Figure 6:
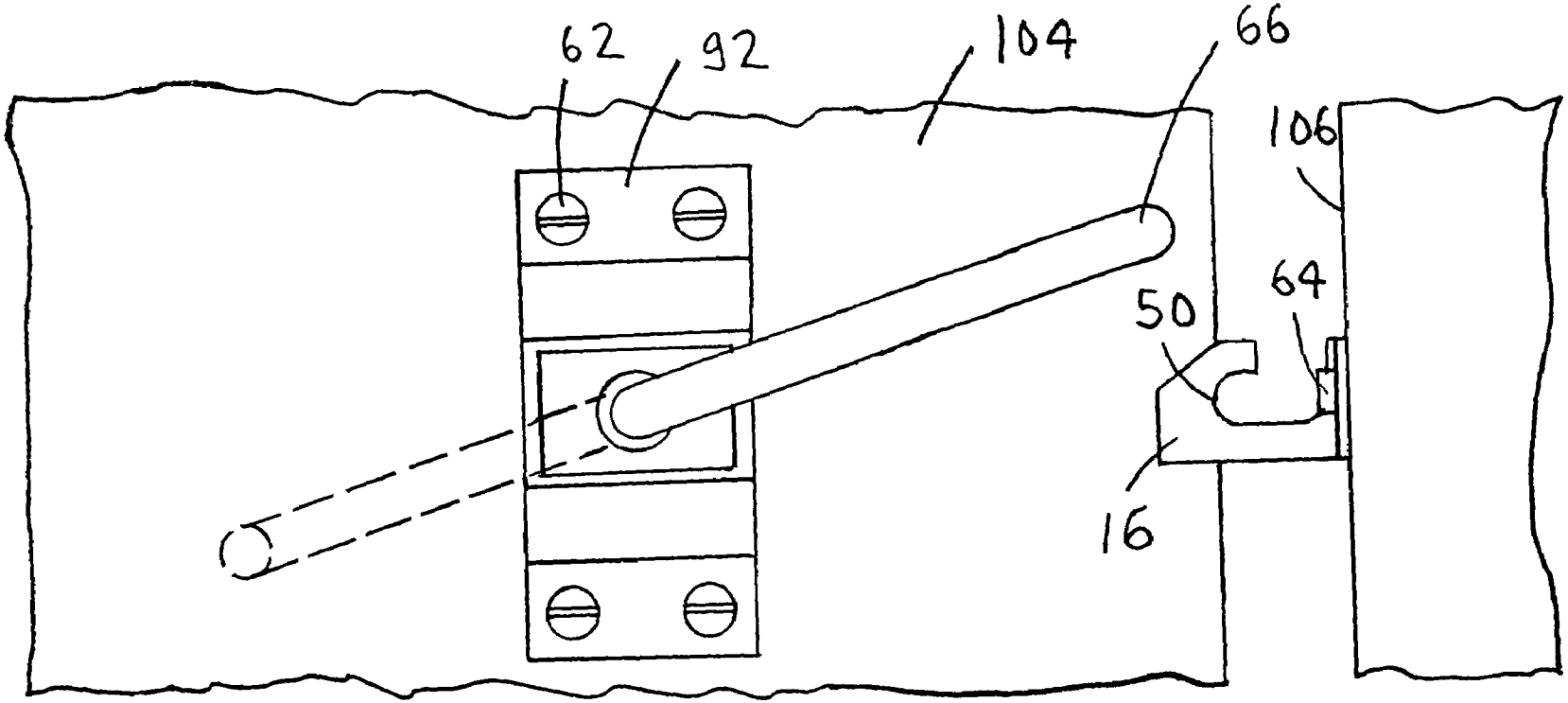
FIG. 6 is a front view of a door latch installed in a sliding door with an S-handle positioned in an open position in accordance with the present invention.

With reference to FIGS. 4, 4*a* and 6, a second embodiment of a door latch 2 includes a torsion S-handle 66, a first mounting plate 68, a second mounting plate 70, the handle latch 16 and a torsion spring 72. The torsion S-handle 66 includes a locking portion 69 and a handle portion 71. The torsion S-handle 66 is identical to the S-handle 10 with the exception of the locking key 30. The torsion spring 72 is preferably secured to a straight portion 67 of the torsion S-handle 66 with a spring retention key 74. A key slot 76 is formed in the straight portion 67 to firmly receive the spring retention key 74. The spring retention key 74 includes a clearance slot 78 for retaining a cross section of the torsion spring 72. However, other methods of securing the torsion spring 72 to the straight portion 67 may also be used, such as welding.

The first mounting plate 68 includes a handle hole 80, a first spring retention opening 82 and at least two fastener openings 84. The second mounting plate 70 includes a handle hole 86, a second spring retention opening 88 and at least two fastener openings 90. A trim plate 92 is preferably retained over the second mounting plate 70. The trim plate 92 includes all the features of the second mounting plate 54 and a second spring retention opening 94. The first spring retention opening 82 provides clearance for a first end of the torsion spring 72. The second spring retention opening 88 and the spring retention opening 94 provides clearance for a second end of the torsion spring 72. A single handle bearing 38 may be inserted into each mounting plate 68, 70.

The door latch 2 is preferably installed in the following manner. A handle opening 105 is formed through a sliding door 104. The handle opening 105 is large enough to provide clearance for the spring retention key 74 and the at least two fasteners 62. The torsion spring 72 is attached to the torsion S-handle with the spring retention key 74. First, the torsion S-handle 66 is pushed through the handle opening in the sliding door 104. The first mounting plate 68 is then pushed on to the straight portion 67, adjacent the first end of the torsion spring 72. The second mounting plate 54 is finally pushed over the straight portion 67, adjacent the second end of the torsion spring 72. The first mounting plate 68, the second mounting plate 70 and the trim plate 92 are retained against the door with the at least two fasteners 62.

Figure 5:
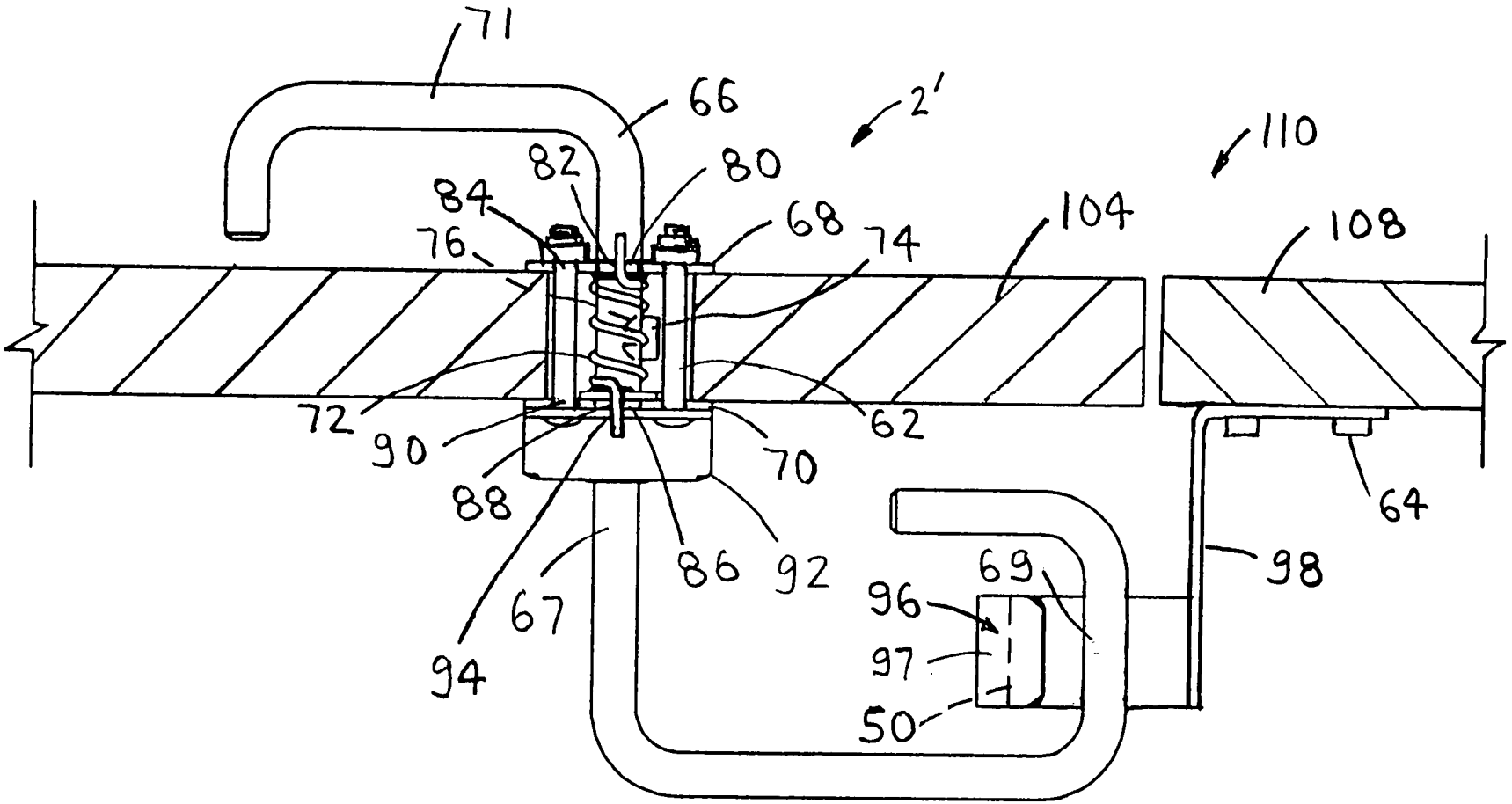
FIG. 5 is a top cross sectional view of a second embodiment of a door latch installed in a bi-sliding door in accordance with the present invention.

The handle latch 16 is attached to a mounting surface 106 adjacent the sliding door 104 with at least two fasteners 64, such that a locking portion 69 of the torsion S-handle is received by the extension slot 50. The mounting surface 106 is shown as a stationary object. However, referring now to FIG. 5, a door latch 2' includes a bi-sliding door 110. The bi-sliding door 110 includes the sliding door 104 and an opposing sliding door 108. A sliding handle latch 96 includes a hook member 97 and an attachment bracket 98. The extension slot 50 is formed in the hook member 97. The attachment bracket extends from a rear of the hook member 97. The attachment bracket 98 is attached to the opposing sliding door 108 with at least two fasteners 64. The door latch 2, 2' is opened by pivoting the locking portion 26 upward and pulling sliding door 104 away from the mounting surface 106 or the opposing sliding door 108.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A method of latching a door, comprising the steps of:

retaining pivotally a handle in the door, said handle having a locking portion on one end and a handle portion on the other end thereof;

attaching a handle latch to a mounting surface adjacent the door, said handle latch having an extension passage leading to an extension slot;

biasing said handle such that said locking portion is retained in said extension slot; and moving said handle axially to remove said locking portion from said extension slot, pivoting said handle to remove said locking portion from said extension passage.

2. The method of latching a door of claim 1, further comprising the step of:

retaining said handle with a locking mounting plate on one side of the door and a mounting plate on the other side of the door.

3. The method of latching a door of claim 2, further comprising the step of:

securing a locking key to said handle, forming a lock slot in said locking mounting plate to receive said locking key.

4. The method of latching a door of claim 1, further comprising the step of:

biasing said handle with a spring.

5. The method of latching a door of claim 1, further comprising the step of:

providing a second mounting plate that is retained adjacent said locking mounting plate.

6. The method of latching a door of claim 5, further comprising the steps of:

inserting a first handle bearing into said mounting plate to pivotally retain said handle; and inserting a second handle bearing into said second mounting plate to pivotally retain said handle.

7. A method of latching a door, comprising the steps of:

providing a handle having a locking portion on one end and a handle portion on the other end thereof;

retaining said handle pivotally with a locking mounting plate on one side of the door and a mounting plate on the other side of the door;

attaching a handle latch to a mounting surface adjacent the door, said handle latch having an extension passage leading to an extension slot;

biasing said handle such that said locking portion is retained in said extension slot; and moving said handle axially to remove said locking portion from said extension slot, pivoting said handle to remove said locking portion from said extension passage.

8. The method of latching a door of claim 7, further comprising the step of:

securing a locking key to said handle, forming a lock slot in said locking mounting plate to receive said locking key.

9. The method of latching a door of claim 7, further comprising the step of:

biasing said handle with a spring.

10. The method of latching a door of claim 7, further comprising the step of:

providing a second mounting plate that is retained adjacent said locking mounting plate.

11. The method of latching a door of claim 10, further comprising the steps of:

inserting a first handle bearing into said mounting plate to pivotally retain said handle; and inserting a second handle bearing into said second mounting plate to pivotally retain said handle.

12. A method of latching a sliding door, comprising the steps of:

retaining pivotally a handle in the sliding door, said handle having a locking portion on one end and a handle portion on the other end thereof;

attaching a handle latch to a mounting surface adjacent the door, said handle latch having an extension passage leading to an extension slot;

biasing said handle radially such that said locking portion is retained in said extension passage; and pivoting said handle such that said locking portion is removed from said extension passage and moving the sliding door away from said handle latch.

13. The method of latching a sliding door of claim 12, further comprising the step of:

retaining said handle with a first mounting plate on one side of the door and a second mounting plate on the other side of the door.

14. The method of latching a sliding door of claim 13, further comprising the step of:

biasing said handle with a torsion spring, retaining at least one end of said torsion spring in one of said mounting plates.

15. The method of latching a sliding door of claim 13, further comprising the steps of:

inserting a first handle bearing into said first mounting plate to pivotally retain said handle; and inserting a second handle bearing into said second mounting plate to pivotally retain said handle.

16. The method of latching a sliding door of claim 12, further comprising the step of:

providing an opposing sliding door for said mounting surface.

* * * * *